United States Patent [19]

Portaleoni

[11] 3,937,433

[45] Feb. 10, 1976

[54] SUPPORT ARRANGEMENTS FOR TURBOMACHINES

[75] Inventor: Libero Portaleoni, Kollbrunn, Switzerland

[73] Assignee: Brown Boveri-Sulzer Turbomaschinen Aktiengesellschaft, Zurich, Switzerland

[22] Filed: Dec. 20, 1973

[21] Appl. No.: 426,480

[30] Foreign Application Priority Data

Jan. 4, 1973 Switzerland ..... 66/73

[52] U.S. Cl. ..... 248/19; 248/DIG. 1

[51] Int. Cl.[2] ..... F16M 13/00

[58] Field of Search ..... 248/2, 17, 19, DIG. 1

[56] References Cited

UNITED STATES PATENTS

| | | | |
|---|---|---|---|
| 1,527,635 | 2/1925 | Doran | 248/2 |
| 1,533,156 | 4/1925 | Baumann | 248/19 |
| 1,678,968 | 7/1928 | Allen | 248/19 X |
| 1,682,317 | 8/1928 | Allen | 248/19 |
| 2,761,639 | 9/1956 | Horn | 248/17 |
| 3,764,098 | 10/1973 | Dickinson | 248/2 |
| 3,781,733 | 12/1973 | Heim | 248/DIG. 1 |

*Primary Examiner*—William H. Schultz
*Attorney, Agent, or Firm*—Kenyon & Kenyon Reilly Carr & Chapin

[57] ABSTRACT

The lower half of the turbomachine casing is mounted so as to retain the casing half in a set horizontal plane despite thermal expansions and contractions. To this end, the support arrangement at one end of the casing half includes vertically disposed rods which have a coefficient of thermal expansion less than that of the casing as well as covers which are secured to the casing and rest on the rods in order to transfer the weight of the casing to the rods. When heated, the rods expand upwardly while the covers expand downwardly. The two expansion effects cancel each other so that the plane of the lower casing half is maintained set.

16 Claims, 3 Drawing Figures

SUPPORT ARRANGEMENTS FOR TURBOMACHINES

This invention relates to support arrangements for turbomachines. In this specification the term "turbomachine" is intended to cover turbines, rotodynamic pumps, and rotodynamic compressors.

It is desirable for the axis of the casing of a turbomachine to remain fixed in vertical position despite changes in the temperature of the turbomachine. In many constructions, for example, variations in the position of the axis may cause the relatively small labyrinth clearances in the dummy or thrust-balancing pistons or glands to be upset, where the bearings of the turbomachine are supported separately from the casing, while if the bearing housings are integral with the casing, difficulties may occur in the input or output shaft coupling.

According to the present invention, a turbomachine includes a support arrangement including vertically-extending rods to each of which a part of the weight of the turbomachine is transferred at a point near the horizontal median plane of the turbomachine, the coefficient of thermal expansion of the material of the rods being less than that of the material of the turbomachine casing, and the support arrangement also being arranged to define the longitudinal position of the adjacent part of the turbomachine.

By appropriately selecting the materials and dimensions of the rods and the casing, it can be arranged that the axis of the casing remains in substantially the same place despite changes in temperature.

The support arrangement may be such that the weight of the turbomachine is transferred to the rods at points above the horizontal median plane of the turbomachine. Preferably the coefficient of thermal expansion of the rods is not more than one-third of that of the casing of the turbomachine.

Where the casing of the turbomachine is split along the horizontal median plane, the lower half of the casing may be provided with lugs having apertures through which the rods extend, and the weight of the turbomachine may be transferred to the rods by covers secured to the upper surfaces of the lugs and resting on the upper ends of the rods. Conveniently the covers are vertically adjustable relative to the lugs.

Preferably the turbomachine includes at least one guide member extending downwards from one of the lugs, the coefficient of thermal expansion of the guide member being substantially the same as that of the turbomachine casing. The or each guide member may be a sleeve surrounding the associated rod. Preferably also there is associated with each rod a sliding member which supports the rod on a base member, the sliding member being constrained to slide only in the horizontal direction transverse of the turbomachine. The turbomachine may be so arranged that horizontal movements are transmitted by the or each guide member to the associated sliding member. This arrangement ensures that the the loads on the rods are purely vertical, so that the rods cannot be tilted.

The position of the turbomachine casing in the transverse horizontal direction may be defined by a connection in the vertical median plane of the turbomachine.

The invention may be carried into practice in various ways, but one embodiment will now be described by way of example, with reference to the accompanying drawings, in which:-

Figure 1:
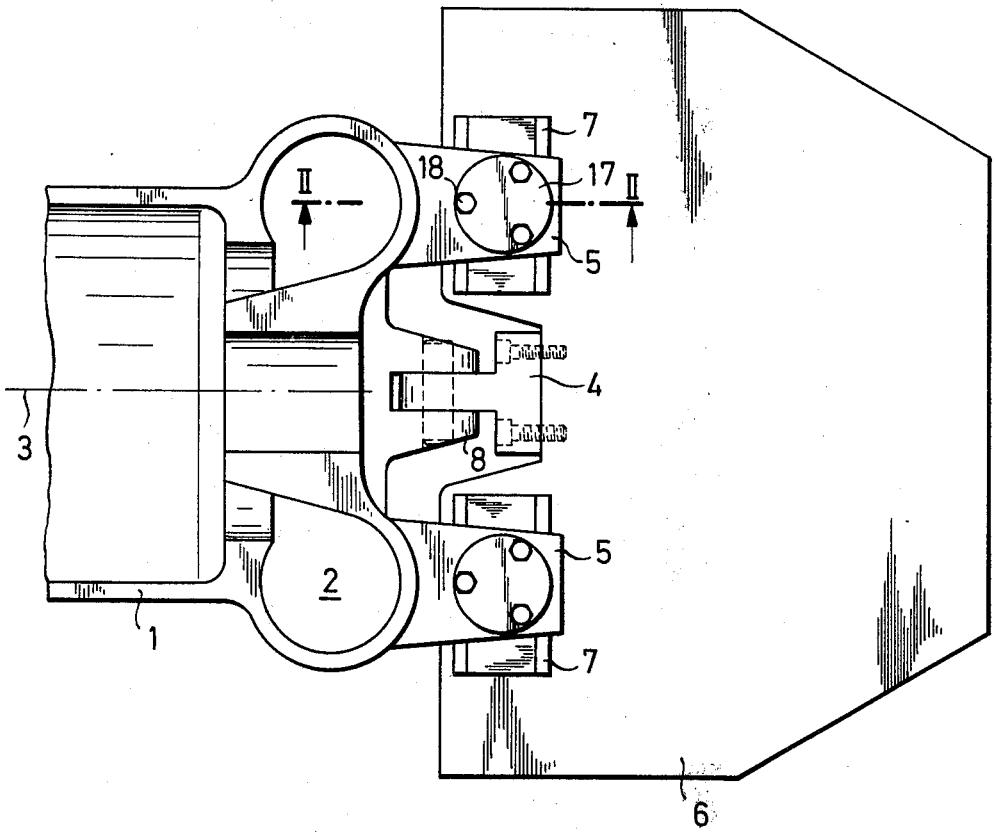
FIG. 1 is a diagrammatic plan view of the delivery end of a turbomachine with the upper half of the casing removed, showing part of the support arrangements for the casing.

FIG. 1 shows the delivery end of the bottom half 1 of a turbomachine casing, including a volute 2. The joint face of the bottom half 1 is horizontal and contains the axis of the rotor of the machine when this is in place. The bottom half 1 of the casing is supported at the delivery end by two lugs 5 which form part of the casing and are supported on a bed plate 6 through two bearing blocks 7. The bearing blocks 7 are so arranged that the bottom half of the casing can slide on the blocks 7 in the horizontal direction normal to the axis of the turbomachine i.e. sideways. The position of the turbomachine in the horizontal direction relative to the bed plate 6 is fixed by a T-shaped member 4 which is secured to the bed plate 6, and which engages in a forked projection 8 provided on the bottom half 1 of the casing below the axis of the turbomachine. The arrangement is such that only forces directed horizontally and normal to the axis of the turbomachine can be transferred from the projection 8 to the member 4; all other forces are transferred through the lugs 5.

The other end of the turbomachine is supported in a broadly similar manner, but since its longitudinal position is fixed by the bearing blocks 7, the lugs at the other end of the machine are supported by horizontally resilient supports of conventional design.

The arrangement of the connections between the lugs 5 and the bearing blocks 7 will now be described in greater detail.

The weight of the turbomachine is transferred from each lug 5 to the associated bearing block 7 by a rod 10, which is made of a material having a very low coefficient of thermal expansion for example, of a coefficient not more than one-third of that of the turbomachine casing. The rod 10 bears on the block 7 by way of various intermediate elements 11 – 13 which will be described in detail hereinafter and which are mounted in a recess 14 in the block 7.

Figure 2:
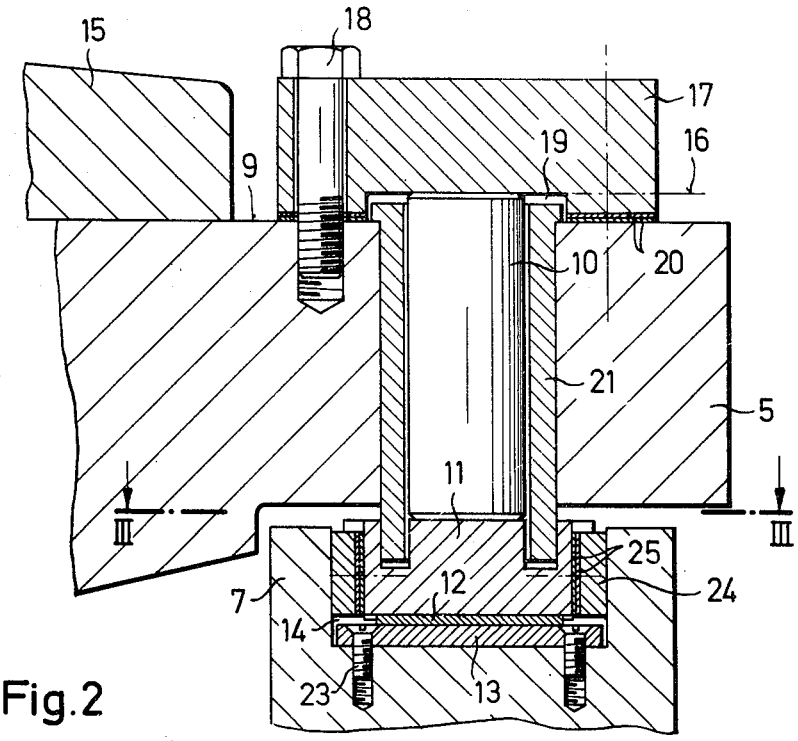
FIG. 2 is a section on the line II—II of FIG. 1 to an enlarged scale, and also shows part of the upper half of the casing.

The plane 16 of the top end of the rod 10 is some distance above and parallel to the plane of the joint face 9 of a lug 5 and bottom casing half 1. To this end, a cover 17 made of a material having the same coefficient of thermal expansion as the material used for the turbomachine casing is secured by screws 18 to the lug 5 and is formed on the underside with a recess 19 which receives the rod 10. The separation between the plane 16 and the plane of the joint face 9 can be varied to some extent by means of shims 20 which are disposed between the cover 17 and the lug 5. The shims 20 thus position the plane 9 at a particular level, for example relative to a rotor supported on separate bearing blocks. During operation, the increase in the distance between the planes 9 and 16 due to thermal expansion can be made to cancel out the corresponding increase in the length of the rod 10, so that there is substantially no displacement of the plane 9. That is, when heated, the rod 10 expands upwardly, as viewed in FIG. 2, from the sliding member 11. Thus, the cover 17 and plane 16 become displaced upwardly. The upward displacement of the cover 17 would also move the plane 9 upwardly, however, because of the thermal expansion of the cover 17 the plane 9 moves downwardly relative to the plane 16. In this way, the downward displacement of the plane 9 caused by the cover 17 cancels the upward displacement of the plane 9 caused by the rod 10.

A sleeve 21 made of a material having the same heat expansion coefficient as the material used for the turbomachine casing is fitted in the lug 5, and surrounds the rod 10. The sleeve 21, which extends downwardly into a bore in a sliding member 11, has various tasks. The sleeve 21 serves to prevent horizontal backlash from occurring between the lug 5 and the rod 10 when thermal expansion or contraction occurs. Also, the sleeve 21 receives the thrusts axial of the turbomachine and transmits them to the bearing block 7; the sleeve 21 also transmits transverse movements of the lug 5, so that the transverse movement of the bearing system takes place in a plane perpendicular to the machine axis. Consequently, all force components which act other than vertically are kept away from the weight-bearing rod 10, which always remains in a vertical position so that the plane 16 of the top surface always remains horizontal.

Figure 3:
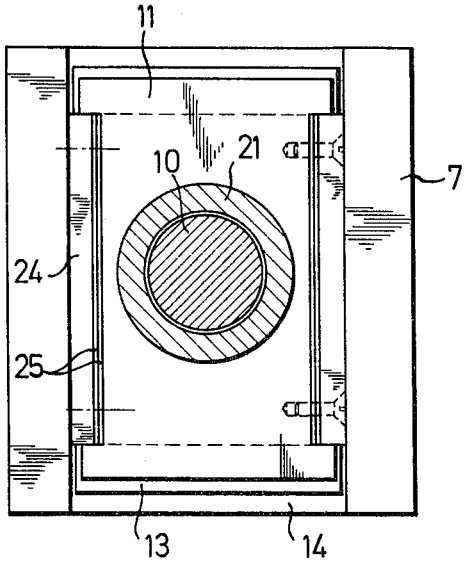
FIG. 3 is a section on the line III—III of FIG. 2.

The rod 10 is supported on the sliding member 11 and the transverse forces applied to the sleeve 21 are transmitted to the sliding member 11 mounted in the recess 14 in the block 7. The member 11 rests on a slipper 13 secured in the recess 14 by screws 23; a low-friction insert 12 facilitates the transverse movements described. As FIG. 3 shows, the recess 14 and the insert 12 are so devised that the member 11 is free to move transversely. However, the member 11 is located axially of the turbomachine by spacer elements 24 which are secured to the side edges as shown. The axial position of the member 11 can be adjusted by means of shims 25.

What we claim is:

1. In combination with a turbomachine having a casing split along a horizontal median plane, a lower half of said casing having a plurality of lugs extending therefrom, each lug having an aperture therethrough; a support arrangement for defining the axial position of said lower casing half including vertically extending rods, each rod being disposed within an aperture of a respective lug and having a coefficient of thermal expansion less than that of said casing and covers secured to an upper surface of said lugs and resting on said rods to transfer the weight of said turbomachine casing to said rods.

2. The combination as set forth in claim 1 wherein said covers are vertically adjustable relative to the lugs.

3. The combination as set forth in claim 1 in which the cofficient of thermal expansion of the rods is not more than one-third of that of the casing of the turbomachine.

4. The combination as set forth in claim 1 including at least one guide member extending downwards from one of said lugs, the coefficient of thermal expansion of said guide member being substantially the same as that of said turbomachine casing.

5. The combination as set forth in claim 4 in which each guide member is a sleeve surrounding the associated rod.

6. The combination as set forth in claim 1 which further includes a base member and a sliding member supporting each respective rod on said base member, said sliding member being constrained to slide only in the horizontal direction transverse of said turbomachine.

7. The combination as set forth in claim 6 in which the position of the sliding member can be adjusted in the direction axial of the turbomachine.

8. The combination as set forth in claim 6 which further includes a sleeve surrounding each respective rod and secured in a respective lug, said sleeve being slidably received in a respective sliding member whereby said sleeve transmits horizontal movements of said casing to said sliding member.

9. The combination as set forth in claim 6 which further includes an intermediate layer of a low coefficient of friction between said sliding member and base member.

10. A support arrangement for supporting a turbomachine casing on a bedplate comprising a bearing block having a recess therein;

a sliding member slidably mounted in said recess of said bearing block for sliding in a horizontal plane, a vertical sleeve mounted on said sliding member, and a vertical rod supported on said sliding member within said sleeve, said rod having a top surface in a horizontal plane located above said sleeve to receive at least a portion of the weight of a turbomachine casing.

11. In combination with a turbomachine casing and a bedplate; a support arrangement comprising a bearing block mounted on said bedplate and including a recess therein;

a sliding member slidably mounted in said recess of said bearing block for sliding in a horizontal plane;

a vertical sleeve fitted in said casing and having a coefficient of thermal expansion equal to the coefficient of thermal expansion of said casing, said sleeve being mounted in said sliding member for transmitting axial thrusts and transverse movements of said casing to said sliding member; and a vertical rod supporting on said sliding member with said sleeve, said rod having a top surface in a horizontal plane located above said sleeve to receive at least a portion of the weight of said casing.

12. The combination as set forth in claim 11 wherein said casing has a bottom half having an upper horizontal joint face defining a median plane of said casing and said top surface of said rod is located near said median plane.

13. The combination as set forth in claim 11 wherein said rod has a coefficient of thermal expansion no more than one-third of said coefficient of said casing.

14. In combination with a turbomachine casing having a lower casing half having a joint face in a first horizontal plane and at least one lug extending therefrom; a bed plate; and a support arrangement for maintaining said joint face in said plane during thermal expansion, said support arrangement including a cover secured to said lug and having a recess, and a vertical rod having an upper surface abutting against said cover within said recess of said cover and in a second horizontal plane spaced above said first horizontal plane to receive at least a portion of the weight of said casing, said rod passing through an aperture in said lug to transmit the weight of said casing to said bed plate.

15. In combination with a turbomachine casing having a lower casing half having a joint face in a first horizontal plane and at least one lug extending therefrom; a bed plate; and a support arrangement for maintaining said joint face in said plane during thermal expansion, said support arrangement including a cover secured to said lug and having a recess, a vertical rod having an upper surface within said recess of said cover and in a second horizontal plane spaced above said first horizontal plane to receive at least a portion of the weight of said casing, said rod passing through an aperture in said lug to transmit the weight of said casing to said bed plate and at least one bearing block on said bed plate and a sliding member slidably mounted on said bearing block in a horizontal plane, said rod being supported on said sliding member.

16. The combination as set forth in claim 8 in which the position of the turbomachine casing in the transverse horizontal direction is defined by a connection in the vertical median plane of the turbomachine.

* * * * *